US005628295A

United States Patent [19]

Todero et al.

[11] Patent Number: 5,628,295

[45] Date of Patent: May 13, 1997

[54] TWO-STROKE INTERNAL COMBUSTION ENGINE

[75] Inventors: Giuseppe Todero, Mandello del Lario; Roberto Sommariva, Pavia, both of Italy

[73] Assignee: McCulloch Italiana Srl, Valmadrera, Italy

[21] Appl. No.: 631,962

[22] Filed: Apr. 15, 1996

[51] Int. Cl.[6] ..... F02M 25/07

[52] U.S. Cl. ..... 123/568; 123/73 AA

[58] Field of Search ..... 123/73 AA, 73 A, 123/65 PE, 568, 65 A, 65 P

[56] References Cited

U.S. PATENT DOCUMENTS

| | | | |
|---|---|---|---|
| 1,103,487 | 7/1914 | Cochran | 123/73 AA |
| 3,475,905 | 11/1969 | Wilford . | |
| 4,325,335 | 4/1982 | Shibata | 123/73 R |
| 4,362,132 | 12/1982 | Neuman | 123/73 D |
| 4,570,439 | 2/1986 | Uchinishi . | |
| 4,622,928 | 11/1986 | Uchinishi | 123/65 PE |
| 4,829,946 | 5/1989 | Boyesen | 123/65 PE |
| 4,848,279 | 7/1989 | Luo | 123/73 V |
| 4,924,819 | 5/1990 | Boyesen | 123/65 PE |
| 5,081,961 | 1/1992 | Paul et al. | 123/51 B |
| 5,111,778 | 5/1992 | Huang | 123/65 PE |
| 5,136,939 | 8/1992 | Sterbenz et al. | 123/65 PE |
| 5,203,310 | 4/1993 | Gatellier | 123/568 |
| 5,267,535 | 12/1993 | Luo | 123/65 PE |
| 5,273,004 | 12/1993 | Duret et al. | 123/73 V |
| 5,331,927 | 7/1994 | Solomon et al. | 123/65 PE |
| 5,379,732 | 1/1995 | Mavinahally et al. | 123/73 AA |
| 5,410,993 | 5/1995 | Masuda et al. | 123/65 PE |
| 5,425,346 | 6/1995 | Mavinahally | 123/568 |

FOREIGN PATENT DOCUMENTS

| | | |
|---|---|---|
| 3712750 | 11/1988 | Germany . |
| 4028757 | 8/1991 | Germany . |
| 58-180721 | 10/1983 | Japan . |
| 60-156925 | 8/1985 | Japan . |
| 3-179130 | 8/1991 | Japan . |

*Primary Examiner*—Marguerite McMahon

*Attorney, Agent, or Firm*—Marshall, O'Toole, Gerstein, Murray & Borun

[57] ABSTRACT

This disclosure relates to a two-stroke engine comprising an engine frame forming a cylinder, and a piston mounted for reciprocating movement in the cylinder. The engine frame further includes a crankcase chamber and inlet flow passages for fresh mixture, which form a crankcase compression arrangement. The cylinder includes a cylinder wall having an intake port and an exhaust port. The piston is movable in compression and combustion strokes between a top-dead-center (TDC) position and a bottom-dead-center (BDC) position in the cylinder, and the piston includes a piston skirt. Movement of the piston toward the BDC position opens the intake port and the exhaust port, and fresh mixture flows from the crankcase chamber into the cylinder and scavenges the burned gases through the exhaust port. When the piston moves toward the TDC position, the inlet flow passage is opened which allows fresh mixture to flow into the crankcase chamber. The exhaust port is also opened, and burned gases in the exhaust port are also drawn into the crankcase chamber and combined with the fresh mixture.

10 Claims, 5 Drawing Sheets

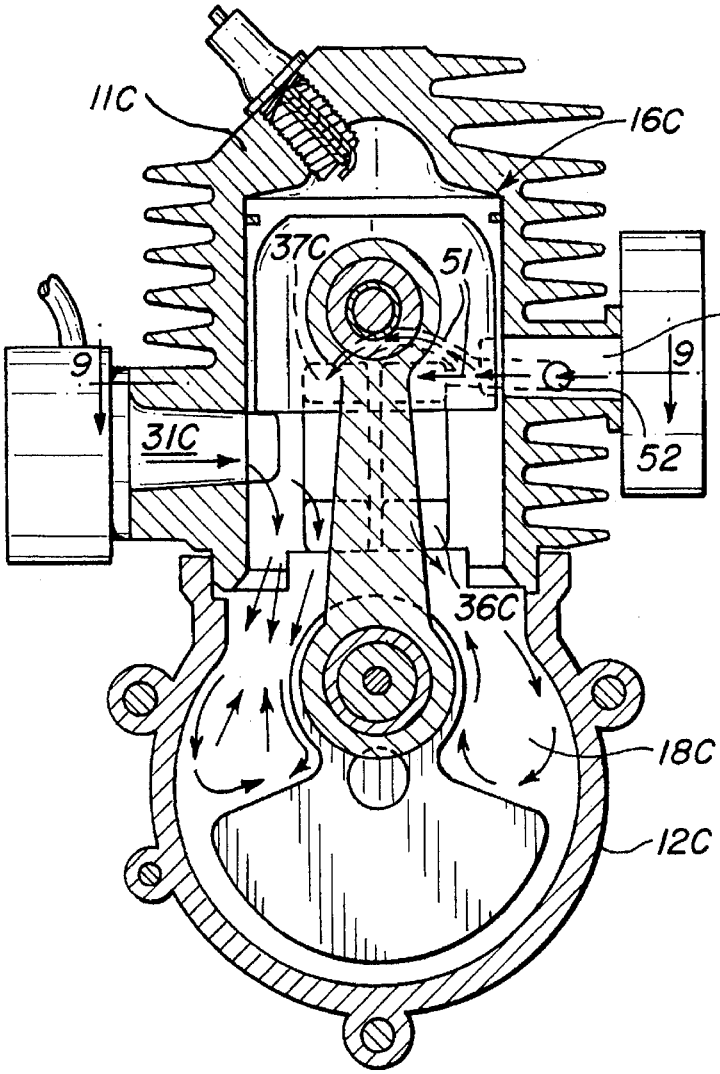
FIG. 7
FIG. 8
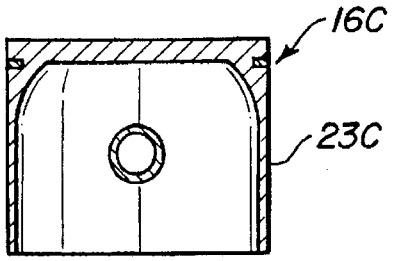
FIG. 9
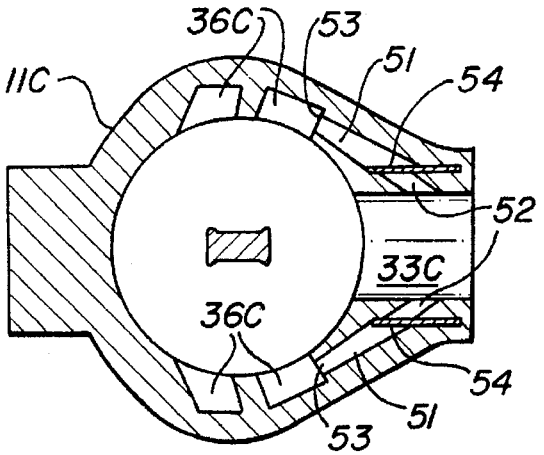

TWO-STROKE INTERNAL COMBUSTION ENGINE

FIELD AND BACKGROUND OF THE INVENTION

This invention relates to a gasoline internal combustion (IC) engine, and more particularly to a two-stroke engine having reduced hydrocarbon emissions.

As is well known to those skilled in this art, a two-stroke engine develops more power than a four-stroke engine of the same displacement, but the prior art two-stroke engines have the disadvantage of producing greater hydrocarbon emissions. The hydrocarbon emissions are due in part to incomplete combustion of the fuel-oil-air mixture and in part to a loss of some of the fresh mixture or charge during the scavenging part of the operating cycle. During scavenging both the inlet port and the exhaust port are open at the same time, and the fresh mixture flows into the combustion chamber and sweeps the burned gases out through the exhaust port. Unfortunately, some of the fresh mixture also passes through the exhaust port, thereby producing the above-mentioned hydrocarbon emissions. The foregoing operation is described in more detail hereinafter in connection with FIG. 1 of the drawings.

It is a general object of the present invention to provide an improved two-stroke engine which substantially reduces the quantity of hydrocarbon emissions.

SUMMARY OF THE INVENTION

A two-stroke engine constructed in accordance with this invention comprises an engine frame forming a cylinder, and a piston mounted for reciprocating movement in the cylinder. The engine frame further includes a crankcase chamber and an inlet flow passage for introducing a fresh mixture into the crankcase chamber and forming a crankcase compression arrangement. The cylinder includes a cylinder wall having an intake port and an exhaust port. The piston is movable in compression and combustion strokes between a top-dead-center (TDC) position and a bottom-dead-center (BDC) position in the cylinder, and the piston includes a piston skirt. Movement of the piston toward the BDC position opens the intake port and the exhaust port, and fresh mixture flows from the crankcase chamber into the cylinder and scavenges the burned gases through the exhaust port. When the piston moves toward the TDC position, the inlet flow passage is opened which allows fresh mixture to flow into the crankcase chamber. The exhaust port is also opened, and burned gases in the exhaust port are also drawn into the crankcase chamber and combined with the fresh mixture.

BRIEF DESCRIPTION OF THE DRAWINGS

The invention will be better understood from the following detailed description taken in conjunction with the accompanying figures of the drawings, wherein:

FIGS. 7, 8 and 9 are views similar to FIGS. 4, 5 and but show still another alternative form of the invention.

DETAILED DESCRIPTION OF THE DRAWINGS

Figure 1:
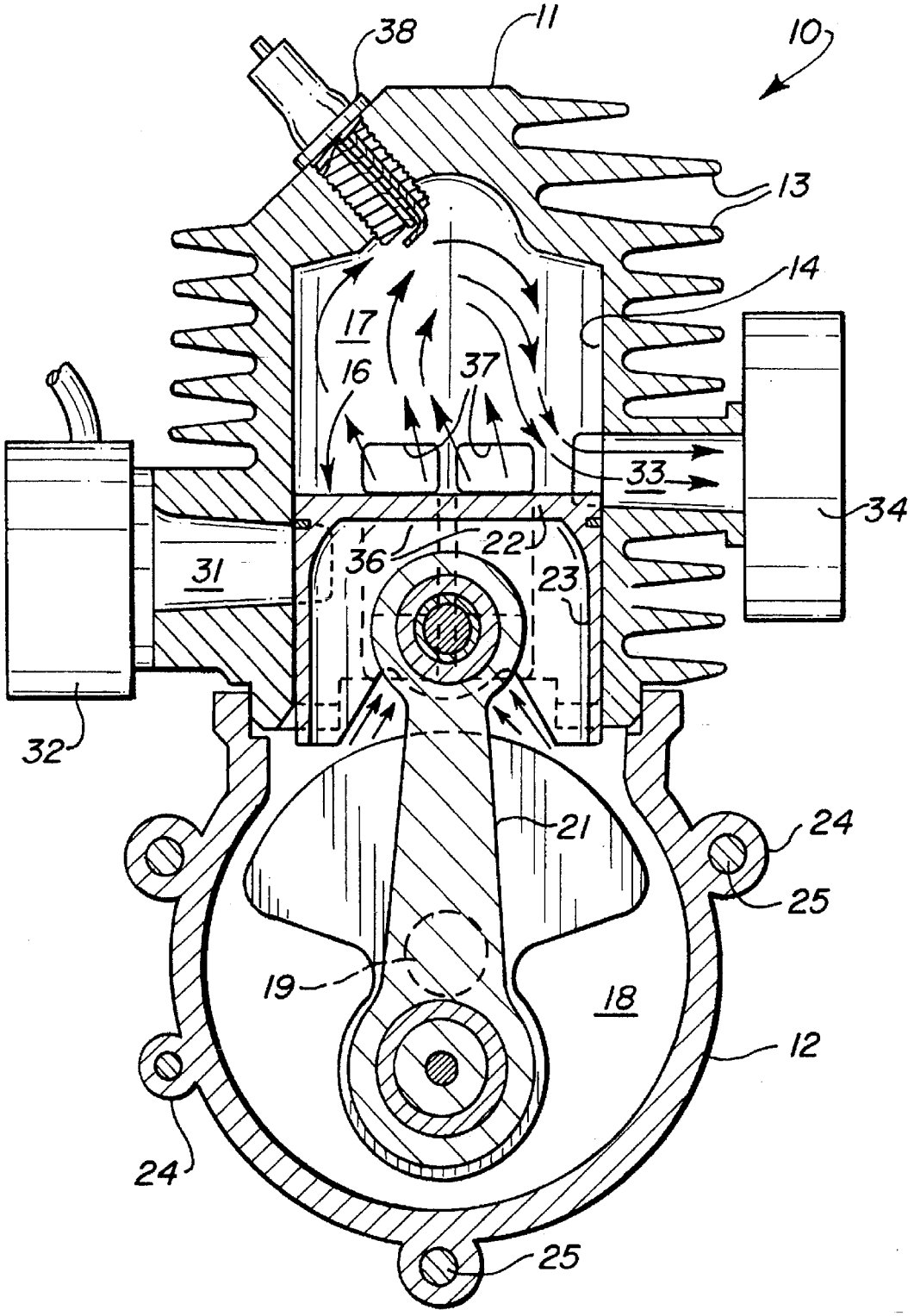
FIG. 1 PRIOR ART
FIG. 1 is a sectional view showing a prior art engine.

FIG. 1 illustrates the construction and operation of a prior art two-stroke engine. The engine comprises an engine frame 10 that includes a block 11 and a crankcase 12. Cooling fins 13 are formed on the outside of the block 11 and a cylinder wall 14 is formed on the inside. A piston 16 is mounted for reciprocation in the cylinder wall 14, the cylinder wall 14 and the piston 16 forming a combustion chamber 17 between them. The crankcase 12 forms a crankcase chamber 18 and a crankshaft 19 is rotatably mounted in the chamber 18. A connecting rod 21 and a crank connect the shaft 19 to the piston 16. The piston 16 includes a crown 22 and a cylindrical skirt 23. Mounting ears 24 and bolts 25 are provided to secure the frame 10 to an implement to be driven.

Flow passages are also formed in the engine frame 10 for a combustible fuel-oil-air mixture or charge and for burnt exhaust gases. The flow passages include an inlet flow passage or duct 31 formed radially through the block 11, and a carburetor 32 is connected to the duct 31. An exhaust duct 33 is also formed radially through the block 11 and connects the combustion chamber 17 with a muffler 34. Scavenging ducts 36 are formed longitudinally through the cylinder wall. 14 and are located to connect the crankcase chamber 18 with the combustion chamber 17 when the piston 16 is adjacent the BDC position. The upper ends of the ducts 36 form inlet ports 37 which are open to the combustion chamber 17 when the piston 16 is in the BDC position.

The engine operates as follows: with the piston 16 in the BDC position shown in FIG. 1, the piston skirt 23 closes the inlet duct or flow passage 31 and opens the exhaust duct 33. The crankcase 18 is filled with fresh mixture or charge which is compressed during the downward movement of the piston at the time when the ports 37 and the duct 31 are closed by the piston 16. When the piston moves down to the level where the ports 37 are open, fresh gas flows from the chamber 18, through the ducts 36 and the inlet ports 37, and into the combustion chamber 17. The flow of fresh gas sweeps, or scavenges, the burnt gases from the combustion chamber 17 out through the open exhaust duct 33. As the piston 16 moves up in the compression stroke, most of the burnt gases are removed and the chamber 17 is filled with fresh mixture. Note that the inlet ports 37 and the duct 33 are located so that the ports 37 are closed slightly ahead of the duct 33 as the piston moves up.

As the piston 16 rises, it opens the inlet duct 31 (see FIG. 2) and fresh mixture is drawn into the crankcase chamber 18 due to the partial vacuum created by the rising piston. At near TDC, a spark plug 38 fires and the piston is forced down in the power stroke.

An engine operating as described above produces excessive hydrocarbon emissions, in part because, shortly before the piston 16 closes the exhaust duct 33, some of the fresh mixture flows into the exhaust duct 33 behind the burnt gases. The fresh mixture is retained in the duct 33 until the beginning of the next scavenging portion of the engine cycle, and then the retained fresh mixture is pushed out of the duct 33 through the muffler 34, ahead of the burnt gases in the next scavenging portion of the cycle.

Figure 2:
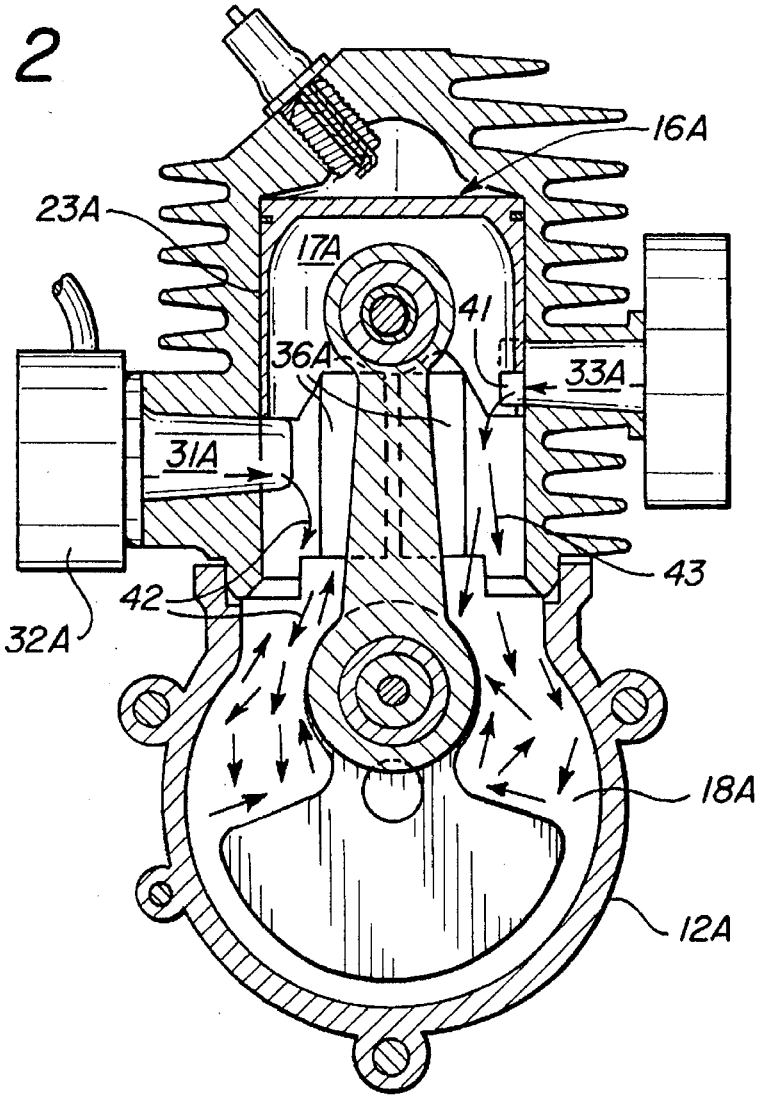
FIG. 2 is a sectional view showing an engine constructed in accordance with this invention.
Figure 3:
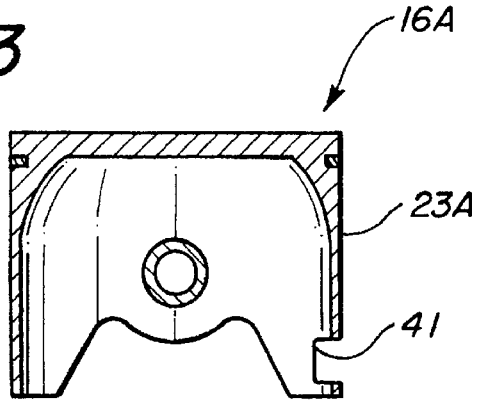
FIG. 3 is a sectional view of a piston of the engine shown in FIG. 2.

The engine shown in FIGS. 2 and 3, constructed in accordance with this invention, has a number of parts which are similar to corresponding parts shown in FIG. 1. The corresponding parts in FIGS. 2 and 3 are given the same reference numerals plus the letter A. Only the differences in construction and operation between the engines of FIGS. 1 and 2 are described in detail.

The piston 16A (FIGS. 2 and 3) has a return opening or passage 41 formed radially through the skirt 23A. The opening 41 is on the side of the piston which faces the exhaust duct 33A, and the opening 41 is located to be in front of the duct 33A when the piston 16A is at TDC (see FIG. 2). As the piston 16A approaches TDC, the moving piston forms a partial vacuum in the chamber 18A, as previously explained. Consequently, when the lower edge of the piston skirt 23A opens the inlet duct 31A and the opening 41 opens the exhaust duct 33A, the retained content (which includes fresh mixture and most likely some burnt gases) in the duct 33A from the previous scavenging portion of the cycle are drawn into the crankcase chamber 18A. The arrows 42 in FIG. 2 represent the fresh mixture from the carburetor 32A, and the arrows 43 represent the retained content from the exhaust duct 33A. The retained content is combined in the crankcase chamber 18A with the fresh mixture from the inlet duct 31A, and the combined gases subsequently flow through the ducts 36A when the piston 16A is next at the BDC position.

In this manner, the fresh mixture in the retained content is returned to the combustion chamber 17A and utilized rather than passed into the environment. In addition, any burned gases in the retained content are mixed with the fresh mixture and recirculated, thereby lowering emissions by lowering the oxides of nitrogen in the exhaust.

Figure 4:
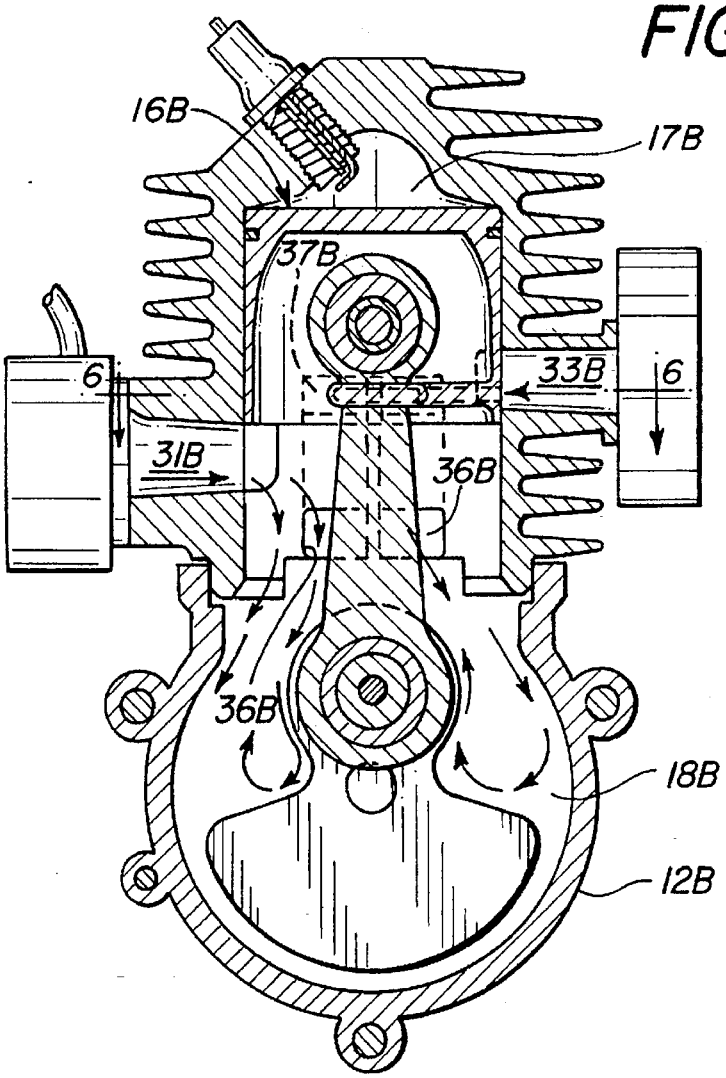
FIGS. 4 and 5 are similar to FIGS. 2 and 3 but show an alternative form of the invention.
Figure 5:
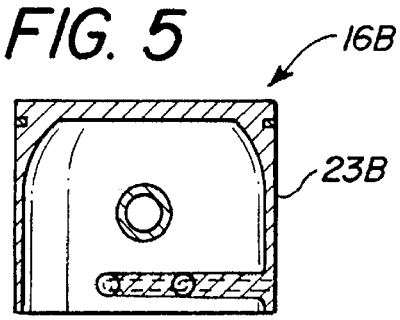
Figure 6:
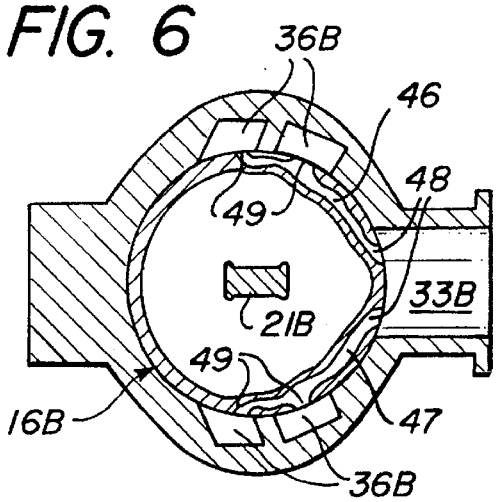
FIG. 6 is a sectional view taken on the line 6—6 of FIG. 4.

With reference to the engine shown in FIGS. 4 to 6, again the same reference numerals are used with corresponding parts but in this instance with the letter B. The piston 16B has two return passages 46 and 47 (see especially FIG. 6) formed in it, the passages extending in the circumferential direction through the skirt 23B. Each of the return passages 46 and 47 has one end opening 48 which is exposed to the exhaust duct 33B and second end openings 49 which are exposed to the ducts 36B, when the piston 16B is in the TDC position. Thus, the retained content in the exhaust duct 33B is moved into the return passages 46 and 47 and the ducts 36B. When the piston 16B subsequently moves down and opens the inlet ports 37B, the retained content in the ducts 36B enters the combustion chamber 17B first, ahead of the fresh mixture from the crankcase chamber 18B. In both of the engines of FIGS. 2 to 6, the return passages are aligned or register with the exhaust duct only when the piston is adjacent the TDC position.

In the engines shown in FIGS. 2 to 6, the return passages are formed at least in part through the piston, and the piston functions as a valve which opens and closes the return passages as it reciprocates. In the engine shown in FIGS. 7 to 9, the return passages are formed entirely in the block 11C.

With particular reference to FIG. 9, return passages 51 are formed in the block 11C. One end 52 of each passage 51 opens into the exhaust duct 33C and the other end 53 of each passage 51 opens into a scavenging duct 36C also formed in the block 11C. A one-way or check valve 54, such as a reed valve, is mounted in each return passage 51 and allows flow only in the direction from the exhaust duct 33C to the scavenging duct 36C.

The engine of FIGS. 7 to 9 functions similarly to those shown in FIGS. 2 to 6. The valves 54 prevent fresh mixture from flowing into the exhaust duct 33C during the scavenging portion of the engine cycle.

In the engines shown in FIGS. 2 to 9, the inlet flow passage for the fresh mixture is formed in the cylinder wall and the inlet flow is controlled by the movement of the piston. Instead, as illustrated in FIG. 10, the inlet flow passage for the fresh mixture may lead directly into the crankcase in all of the embodiments disclosed herein.

Figure 10:
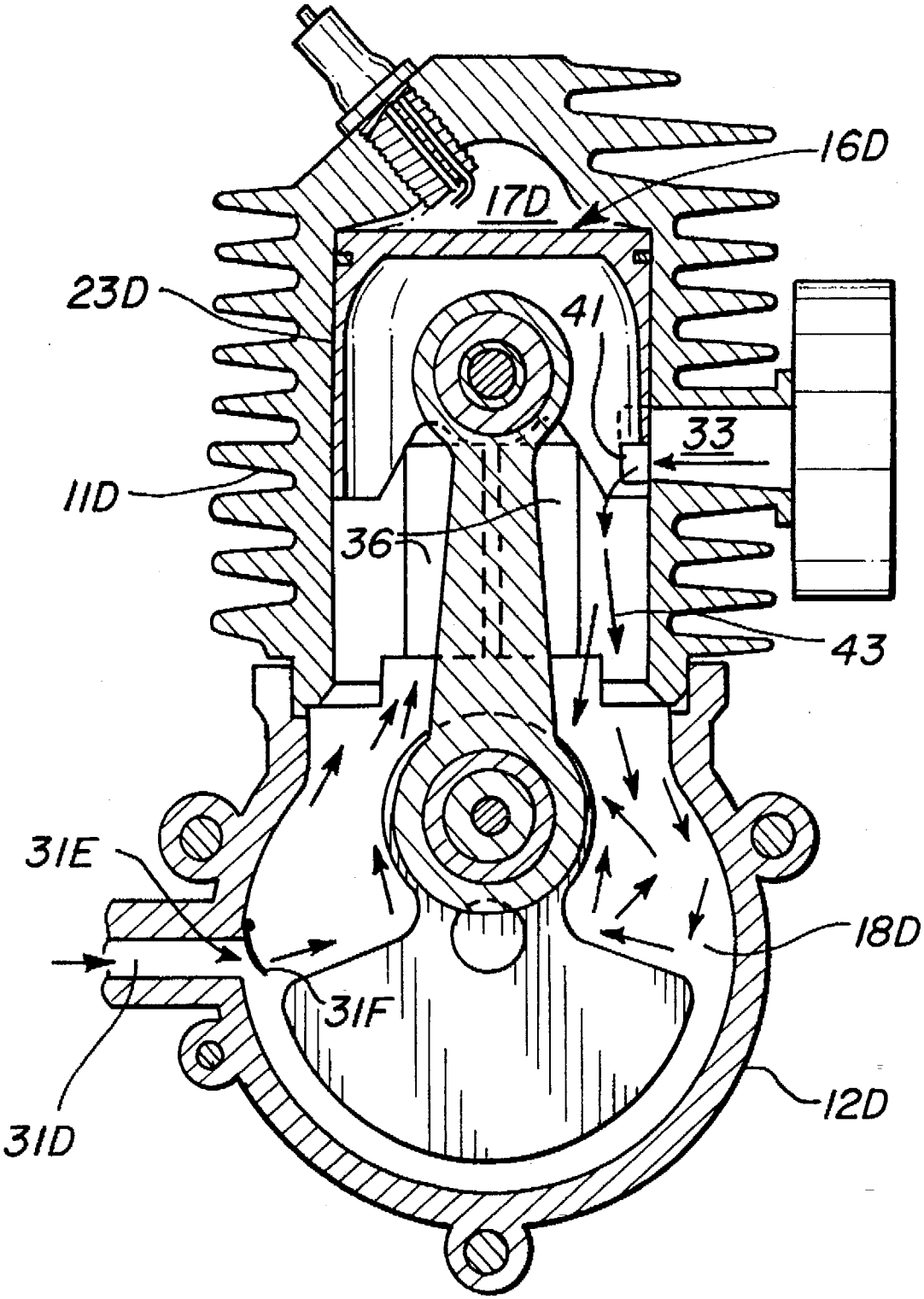
FIG. 10 is a view similar to FIG. 2 but shows still another alternative embodiment.

With specific reference to FIG. 10, the engine includes a block lid and a crankcase 12D which forms a crankcase chamber 18D. A piston 16D reciprocates in a chamber 17D, the piston including a cylindrical skirt 23D.

In this embodiment of the invention, an inlet flow passage or duct 31D connects a carburetor (not shown in FIG. 10) to the crankcase chamber 18D. An intake valve 31E is mounted in the duct 31D and controls the flow of the fresh gas into the chamber 18D. While a variety of valve types, such as a reed valve or a rotary valve, may be used, a reed valve 31F is shown in FIG. 10. The valve 31E opens to allow the flow of fresh gas into the chamber 18D when the piston 16D moves up and forms a partial vacuum in the chamber 18D. The valve 31E closes when the piston moves down. The other parts of the engine are constructed and operate similarly to those of the embodiment shown in FIGS. 2 and 3. In an embodiment wherein the valve 31E comprises a rotary valve, the rotary valve is coupled to be rotated in timed relation with the movement of the piston. This may be accomplished by a gear coupling between the crankshaft and the rotary valve. The rotary valve would be configured and rotated such that the inlet flow passage is open only during the time that the piston is moving upwardly to the TDC position.

Further, the embodiments shown in FIGS. 4 to 9 may have the inlet duct connected to the crankcase chamber as shown in FIG. 10 instead of to the cylinder wall as shown in FIGS. 4 to 9.

It will be apparent from the foregoing that an engine in accordance with this invention has reduced exhaust emissions. The fresh mixture and burnt gas in the retained content of the exhaust duct are returned and recirculated into the combustion chamber rather than expelled through the muffler, thereby reducing the engine emissions into the environment.

What is claimed is:

1. A two-stroke engine comprising an engine frame including a cylinder wall forming a combustion chamber, said frame further including a crankcase chamber and an inlet flow passage for introducing fresh mixture into said crankcase chamber, a piston mounted for reciprocating movement between a TDC position and a BDC position in said combustion chamber, said cylinder wall having an intake port and an outlet duct formed therein, said piston moving past said intake port and said outlet duct during said reciprocating movement, said intake port being open and in flow communication with said crankcase chamber and said combustion chamber when said piston is adjacent said BDC position, and said exhaust duct being open and in flow communication with said combustion chamber when said piston is adjacent said BDC position, and a return passage for connecting said exhaust duct with said crankcase chamber when said piston is adjacent said TDC position.

2. A two-stroke engine as set forth in claim 1, wherein said return passage comprises a return opening formed through said piston.

3. A two-stroke engine as set forth in claim 2, wherein said piston comprises a crown and a cylindrical skirt, and said return opening is formed through said skirt.

4. A two-stroke engine as set forth in claim 3, wherein said return opening extends generally radially through said skirt.

5. A two-stroke engine as set forth in claim 3, wherein said return opening extends generally circumferentially in said skirt between said exhaust duct and said scavenging duct.

6. A two-stroke engine as set forth in claim 1, wherein said return passage is formed in said cylinder wall.

7. A two-stroke engine as set forth in claim 6, wherein said return passage extends generally circumferentially in said cylinder wall between said exhaust duct and said scavenging duct.

8. A two-stroke engine as set forth in claim 7, and further comprising a check valve in said return passage for permitting flow only toward said scavenging duct.

9. A two-stroke engine as set forth in claim 1, wherein said inlet flow passage extends through said cylinder wall and is opened or closed by said piston.

10. A two-stroke engine as set forth in claim 1, wherein said inlet flow passage extends into said crankcase chamber, and further including an inlet valve for controlling flow of fresh mixture into said crankcase chamber.

* * * * *